United States Patent [19]

Watson

[11] 4,320,555

[45] Mar. 23, 1982

[54] CONVERTIBLE VACUUM CLEANER

[76] Inventor: Charles F. Watson, 2606 Wentworth, Pasadena, Tex. 77506

[21] Appl. No.: 141,793

[22] Filed: Apr. 21, 1980

[51] Int. Cl.[3] ..... A47L 7/00

[52] U.S. Cl. ..... 15/321; 55/220

[58] Field of Search ..... 15/321, 322, 353; 55/220, 235, 238

[56] References Cited

U.S. PATENT DOCUMENTS

| | | | |
|---|---|---|---|
| 1,363,860 | 12/1920 | Fetters et al. | 15/353 X |
| 2,184,731 | 12/1939 | Brewer | 55/238 X |
| 3,977,039 | 8/1976 | Block | 15/346 |
| 4,062,085 | 12/1977 | Duncan | 15/353 X |
| 4,078,908 | 3/1978 | Blackman | 15/353 X |

*Primary Examiner*—Chris K. Moore

*Attorney, Agent, or Firm*—Pravel, Gambrell, Hewitt, Kirk, Kimball & Dodge

[57] ABSTRACT

A vacuum cleaner which can alternately be used as a wet vacuum or a dry dust-free vacuum includes a suction head adapted to engage a surface to be vacuumed and a vacuum chamber which includes an inlet and outlet adapted to hold a quantity of liquid and solid material and liquid and other material entering the chamber through the inlet is prevented from entering the outlet. A partial vacuum is created in the chamber and a hose connecting the cleaning head and inlet creates suction in the head and transports material vacuumed from the surface to the chamber. A liquid nozzle with an outlet can be hooked up to spray liquid on the surface to be vacuumed near the suction head and liquid under pressure is supplied to the nozzle through a conduit. The liquid conduit can be connected to supply liquid to the nozzle so that the vacuum cleaner can be used to shampoo a surface or to a position where liquid is supplied to the interior of the hose so that material vacuumed from a surface will be combined with water before entering the chamber for dust-free operation.

6 Claims, 4 Drawing Figures

10
12
14
16
18
20
22
24
25
26
28
32
34
36
38
40
42
44
46
3
3

CONVERTIBLE VACUUM CLEANER

TECHNICAL FIELD

The subject invention relates to vacuum cleaners and, more particularly, to such an apparatus which is convertible between a wet vacuum cleaner and a dust-free dry vacuum cleaner.

Vacuum cleaners have been designed for both wet and dry applications. A wet vacuum cleaner removes liquids from a surface and includes a separator so that liquids can be separated from the air that provides a suction and then deposited in a tank. In some devices liquid is simply removed from a surface while in other devices a spray nozzle is situated near the suction head of the wet vacuum cleaner for spraying water either along or in combination with a detergent onto a surface such as a rug or carpet and the suction head picks up the combination of liquid and solid material for cleaning the surface.

A dry vacuum cleaner picks up dry solid particles by applying suction to the particles and transporting them to a porous filter bag so that most of the solid material is removed before the air which provides the suction passes through a vacuum pump. A significant drawback of this type of apparatus is that there are many minute particles of dust in the dry material which escape through the holes of the filter into the interior of the vacuum cleaner or onto the surface which has already been cleaned. This problem becomes more severe as the filter bag fills up since the same volume of air must travel through a smaller number of openings in the bag which consequently generates more dust because of the greater air velocity through the openings forcing more dust out through them.

BACKGROUND ART

Several U.S. patents are known which deal with wet vacuum machines where liquid is sprayed onto the surface to be cleaned in the vicinity of a suction head. These patents include the following U.S. Pat. Nos.: 1,059,136 to Gafney; 2,972,769 to Keating, et al.; 3,496,592 to Jones; 3,687,729 to Winburn, et al.; and 3,909,197 to Cremers.

DISCLOSURE OF THE INVENTION

A convertible vacuum cleaner has been developed in accordance with the invention, which combines advantageous characteristics of both wet and dry vacuum cleaners. The machine can alternately be used as a wet vacuum cleaner or as a dry vacuum cleaner which has the additional advantage of dust-free operation.

The device includes a suction head which is adapted to engage and move along a surface to be vacuumed. The head is connected through a suction hose to an inlet of a vacuum chamber which can hold a quantity of liquid and solid material. The inlet and an outlet in the vacuum chamber which is connected to a vacuum pump are separated from each other so that liquid and other material entering the chamber through the inlet will not be sucked into the pump.

A liquid nozzle is connected to the head for spraying liquid onto the surface being cleaned in the vicinity of the suction head. A liquid supply means in the form of a tank is connected to the nozzle through a liquid conduit to a pump for supplying liquid under pressure to the nozzle. The liquid conduit can selectively be connected to the nozzle or the suction hose or a valve can be mounted in the liquid conduit and connected to the suction hose so that liquid can be supplied either to the nozzle so that the vacuum cleaner can be used for wet vacuuming or to the vacuum hose where liquid is sprayed into the interior of the suction hose so that dry material vacuumed from the surface mixes with water before entering the vacuum chamber. In this way, the dust and other dry particles are mixed with the water to form a slurry which can be deposited in the vacuum chamber. Since most if not all of the solid material is combined with the water, the device is essentially dust free.

The subject vacuum cleaner is a versatile machine which can be used for both wet and dry vacuuming. A detergent can be added to water in the water tank for shampooing rugs and carpets or it can simply be used to clean spilled liquids. The machine can easily be switched to the dry mode simply by adjusting the valve so that water will be sprayed into the hose for dust-free operation.

BRIEF DESCRIPTION OF THE DRAWINGS

A better understanding of the invention can be obtained when the following detailed description of a preferred embodiment is considered in conjunction with the accompanying drawings, in which.

BEST MODE FOR CARRYING OUT THE INVENTION

Figures 1, 2, 3, 4:
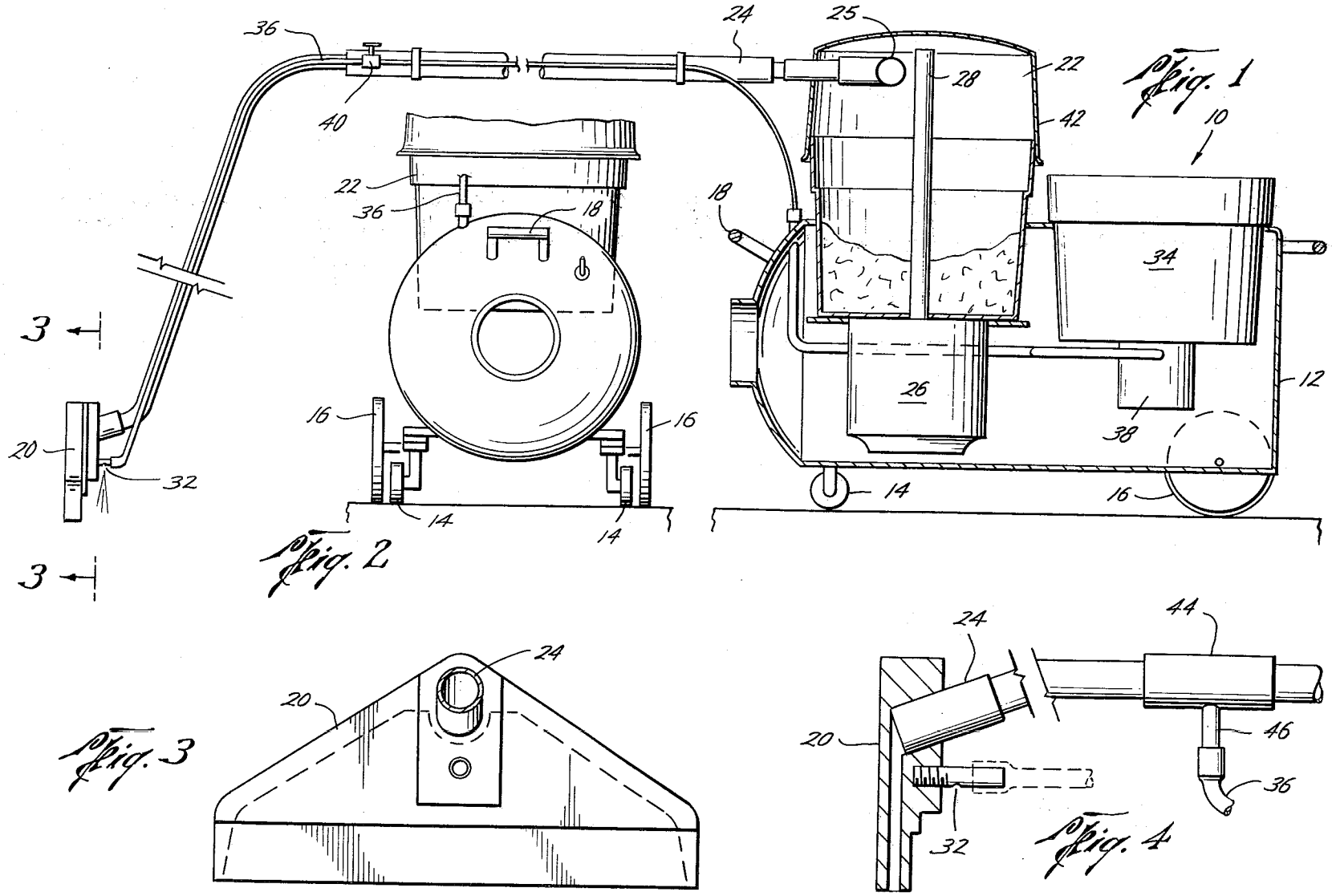
FIG. 1 is a front sectional view of the convertible vacuum cleaner.
FIG. 2 is a side plan view of the convertible vacuum cleaner shown in FIG. 1.
FIG. 3 is a plan view of one side of the suction head of the convertible vacuum cleaner looking along a section line shown in FIG. 2 in the direction of arrows 3—3.
FIG. 4 is a section view of the suction head shown in FIG. 3 and a portion of the suction hose to which the liquid conduit can be attached.

Referring to FIGS. 1 and 2, a convertible vacuum cleaner generally designated by reference numeral 10 includes a housing 12 with suitable wheels 14 and 16 for transporting the cleaner 10 and a handle 18 so that the cleaner 10 can easily be carried or pulled. A suction head 20 is connected to a vacuum chamber 22 through a flexible hose 24 and hose inlet 25. A vacuum pump 26 communicates with the vacuum chamber 22 through a chamber outlet 28 for creating a partial vacuum in the chamber 22 which in turn creates a suction in the head 20.

The vacuum chamber 22 is adapted to hold a quantity of liquid as well as any solid material which is removed from a surface being cleaned. In order to create suction in the head 20 as well as deposit the material in the chamber 22 without the material flowing into the vacuum pump 26, the inlet 25 and outlet 28 are separated and spaced apart from each other so that whenever material flows into the chamber 22 through the inlet 25 it will fall downwardly into the chamber as shown in FIG. 1 and be separated from the transporting air which itself flows through the outlet 28 and into the vacuum pump 26.

A spray nozzle 32 is connected to the suction head 20 which, as shown best in FIG. 4, can be in the form of a pipe section which threadedly engages the head 20. The nozzle 32 is connected to a water tank 34 through a conduit 36 which includes a suitable pump 38 for supplying water under pressure to the nozzle 32 so it can be sprayed onto the surface to be cleaned. In this way, the vacuum cleaner 10 can be used as a wet vacuuming device for cleaning carpets, rugs and the like.

A valve 40 is provided in the conduit 36 and communicates with a hose 24 so that the vacuum cleaner 10 can be converted from a wet to a dry vacuum cleaner and vice-versa. The conversion can be made simply by manually adjusting the valve 40 so that it allows fluid to flow either through the conduit 36 to the nozzle 32 for the wet vacuuming mode or into the suction hose 24 for dry dust-free operation. Whenever fluid is diverted into the hose 24 it is sprayed through a suitable nozzle (not shown) so that the liquid is mixed with dry material for flowing through the hose 24. Alternatively, as shown in FIG. 4, a sleeve 44 can be connected between adjacent sections of the suction hose 24 which includes a T-connection 46. The liquid conduit can be connected to the T-connection 46 for dust-free dry vacuuming or to the nozzle 32 for wet vacuuming as indicated by the ghost lines on FIG. 4. The sump 38 can be turned off so that the vacuum cleaner can clean up spilled liquid without supplying any liquid to the conduit 36.

During the dust-free dry vacuuming operations, the solid material and liquid mix together and form a slurry which is deposited in the vacuum chamber 22, as described above. By mixing the vacuumed solid material with the water, most if not all of the dust moving through the hose 24 will become part of the mixture and be prevented from escaping from the vacuum cleaner back onto the surface being cleaned or into other sections of the vacuum cleaner. When the operator wants to convert the vacuum cleaner back to use as a wet cleaner, either the valve 40 can simply be readjusted so that liquid from the tank 34 flows from the conduit 36 through the nozzle 32 or the alternative embodiment shown in FIG. 4. The liquid conduit 36 can be switched from the T-connection to the nozzle 32. The vacuum chamber 22 can be provided with a removable top 42 so that any liquid and solid material in the chamber 22 can easily be removed.

By providing a vacuum of this design, the advantageous features of a wet vacuum are combined with a dry vacuum in order to provide a versatile machine which can be used both for wet and dry vacuuming and, in addition, provide dustfree operation under dry vacuuming conditions.

The foregoing disclosure and description of the invention are illustrative and explanatory thereof, and various changes in the size, shape and materials as well as in the details of the illustrated construction may be made without departing from the spirit of the invention and all such changes are contemplated as falling within the scope of the appended claims.

What is claimed is:

1. Vacuum cleaner which can be used for dry dust-free vacuuming comprising:

(a) a suction head adapted to engage a surface to be vacuumed;

(b) a vacuum chamber including an inlet and outlet adapted to hold a quantity of liquid and solid material, the chamber including means for preventing liquid and other material entering the chamber through the inlet from entering the outlet;

(c) means connected to the outlet for creating a partial vacuum in the chamber;

(d) a hose connecting the suction head and inlet for creating suction in the head and transporting material vacuumed from said surface to the chamber;

(e) a liquid conduit and liquid supply means for supplying liquid under pressure to the liquid conduit, the conduit connecting the liquid supply means with the hose so that liquid can be supplied from the liquid supply means to the interior of the hose so that material vacuumed from the surface will be combined with water before entering the chamber for dust-free operation; and (f) means for selectively connecting the liquid supply means to a liquid nozzle with an outlet for spraying liquid on the surface to be vacuumed near the suction head, whereby liquid can selectively be supplied to the interior of the hose or to the liquid nozzle.

2. The vacuum cleaner of claim 1 wherein the means for selectively connecting includes connecting the conduit to the liquid nozzle with an outlet for spraying liquid on the surface to be vacuumed near the suction head, and a valve is connected to the hose and conduit which is adjustable between a first position where liquid is supplied from the liquid supply means to the nozzle and a second position where liquid is supplied to the hose.

3. The vacuum cleaner of claim 2, wherein the valve is mounted in the conduit and communicates with the hose.

4. The vacuum cleaner of claim 1, wherein the means for preventing includes separating the inlet and outlet in the upper portion of the chamber.

5. The vacuum cleaner of claim 1, wherein the nozzle is mounted on the suction head.

6. The vacuum cleaner of claim 1, wherein the means for selectively connecting includes forming the liquid conduit of a flexible material, a conduit fitting on each of the nozzle and hose so that the conduit can selectively be connected to one of the fittings for supplying liquid thereto.

* * * * *